United States Patent [19]

Hamilton

[11] 4,338,766

[45] Jul. 13, 1982

[54] APPARATUS AND METHOD FOR PRODUCING A CONTAINER FOR FOODS AND THE LIKE

[76] Inventor: Joel A. Hamilton, 101 Hardenburgh Ave., Demarest, N.J. 07627

[21] Appl. No.: 204,305

[22] Filed: Nov. 5, 1980

Related U.S. Application Data

[63] Continuation-in-part of Ser. No. 80,685, Oct. 1, 1979, and a continuation-in-part of Ser. No. 19,462, Mar. 9, 1979, abandoned.

[30] Foreign Application Priority Data

| | | | |
|---|---|---|---|
| Feb. 18, 1980 | [CA] | Canada | 345843 |
| Feb. 19, 1980 | [IE] | Ireland | 314/80 |
| Feb. 22, 1980 | [IL] | Israel | 59449 |
| Feb. 22, 1980 | [WO] | PCT Int. (Appl.) | US80/00172 |
| Feb. 27, 1980 | [AU] | Australia | 55926/80 |
| Feb. 28, 1980 | [FR] | France | 80 04456 |
| Mar. 4, 1980 | [IT] | Italy | 48068 A/80 |
| Mar. 5, 1980 | [BE] | Belgium | 199680 |
| Mar. 6, 1980 | [AR] | Argentina | 280206 |
| Mar. 6, 1980 | [MX] | Mexico | 181455 |
| Mar. 6, 1980 | [PH] | Philippines | 23733 |
| Mar. 7, 1980 | [CL] | Chile | 154/80 |
| Mar. 7, 1980 | [CO] | Colombia | 189856 |
| Mar. 7, 1980 | [ES] | Spain | 489.297 |
| Mar. 7, 1980 | [VE] | Venezuela | 355 |
| Mar. 8, 1980 | [KR] | Rep. of Korea | 961/80 |
| Apr. 30, 1980 | [ES] | Spain | 491.079 |

[51] Int. Cl.[3] ..... B65B 3/02

[52] U.S. Cl. ..... 53/456; 53/453; 53/459; 53/574

[58] Field of Search ..... 53/456, 450, 553, 555, 53/452, 462, 463, 558, 574, 559, 467, 281, 282

[56] References Cited

U.S. PATENT DOCUMENTS

| | | | |
|---|---|---|---|
| 2,091,126 | 8/1937 | Speer | 53/456 X |
| 3,300,944 | 1/1967 | Thesing | 53/552 X |
| 3,345,795 | 10/1967 | Anderson | 53/452 X |
| 3,726,058 | 4/1973 | Stark | 53/456 |
| 3,797,197 | 3/1974 | Fluck | 53/456 X |

*Primary Examiner*—Horace M. Culver
*Attorney, Agent, or Firm*—Ralph R. Roberts

[57] ABSTRACT

There is shown apparatus and method for producing a container preferably made or constructed of heat sealable material. Shaping of the container is by forming and not heat stretching or other distortions. In the depicted examples of the container the travelling strip is formed with a midwidth transverse cut leaving on and at each edge a carrier strip. The formed container is preferably filled with a product and then a cover to retain the product is brought to this container and heat sealed in place by the apparatus. After this filling and sealing, the package is further severed at the prior transverse cut to make separate packages.

10 Claims, 26 Drawing Figures

APPARATUS AND METHOD FOR PRODUCING A CONTAINER FOR FOODS AND THE LIKE

REFERENCE TO RELATED APPLICATION

This is a Continuation-In-Part of my application Ser. No. 080,685 filed Oct. 1, 1979 and a Continuation-In-Part of my application Ser. No. 019,462, filed Mar. 9, 1979 (Abandoned). Both of these applications had like titles. This application pertains only to the embodiment using "I" shaped cuts in the lower film.

BACKGROUND OF THE INVENTION

1. Field of the Invention

With reference to the classification of art as established by and in the U.S. Patent and Trademark Office, this invention is believed to be in the general Class entitled, "Package Making" (Class 53) and in the Subclass entitled, "Receptacle Formed and Subsequently Filled" (Subclass 29) and/or the Subclass entitled, "Forming or Partially Forming Receptacles and Subsequent Filling" (Subclass 183).

2. Description of the Prior Art

Packages for food products are well-known. In particular, packages of processed and/or mixed products ready for opening, serving and/or immediately using are very widely used. Foods served on airliners, such as jellies and the like, are such packaged products. Fast food outlets provide individual servings of condiments such as ketchup, mustard, salad dressing mixtures and the like. In such packaged products it is customary to employ a heat forming of the pocket or recess in the bottom or component receiving strip of the package. After forming and filling the pocket in this strip with the product, a cover member is usually sealed in place around the flat planar surface to retain the product in place. This cover usually has the same or equal barrier properties as the carrier strip. After forming, filling and sealing by affixing a cover, the completed package is usually cut apart into separate packages.

Patent disclosures directed to the above package making or to the making or filling of bags are shown in part by U.S. Pat. No. 2,749,817 to Piazze et al., as issued on June 12, 1956; U.S. Pat. No. 3,667,354 to Steinmetz as issued on June 6, 1972; U.S. Pat. No. 3,762,617 to Matthis as issued on Oct. 2, 1973; U.S. Pat. No. 3,813,998 to Lotto as issued on June 4, 1974; U.S. Pat. No. 3,884,129 to Monahan as issued on May 20, 1975 and my U.S. Pat. No. 4,048,782 as issued on Sept. 20, 1977. Foreign patents are represented by British Pat. No. 1,075,540 as filed on Nov. 9, 1964.

In these and other known art, the pocket is usually formed in at least the bottom carrier strip by heat or the carrier strip is otherwise stretched. Other box-forming means include blanks cut, creased and then folded to provide a receptacle. Cover means is then applied to retain the product.

SUMMARY OF THE INVENTION

In the present invention, it is anticipated that a lower strip is advanced to a transverse cutting means whereat the strip is cut midway with an "I" cut to leave edge carrier portions on both sides of the strip. This advancement of the strip may be continuous or intermittent. This strip, usually a bottom strip, may be a foil, paper, a laminate or any strip material providing a satisfactory wrapper for the particular material to be packaged. After an "I" shaped transverse cut in the bottom strip has been made, the strip is troughed by appropriately shaped dies, rollers or fingers as and with the side portions moved toward each other. The central portion of this strip is bent transversely to form a stop or end. The formed rectangular box portion is filled with the product to be packaged, and then a cover is sealed in place. The resulting packaged product is then preferably cut into separate units.

This invention may be summarized, at least in part, by reference to its objects.

It is an object of this invention to provide, and it does provide, packaging apparatus wherein at least the carrier strip is formed into a pocket or pouch without stretching or heat shaping. The ends of the formed pocket or pouch are adjacent to transverse cuts made in the carrier web or strip. These end portions are transverse of the strip and provide a dam or stop for the product to be packaged. The cover is sealed in place to the sides and the end planar portions of the lower carrier to provide a sealed package which may provide a hermetic seal of the product to be packaged. After forming and sealing the package, the carrier strip is further severed to provide individual packages of the product.

It is a further object of this invention to provide, and it does provide, a pocket or pouch formed in a travelling strip which may be of foil, paper, a laminate or the like. This pocket or pouch is formed by a shaping mandrel without the benefit of heat forming. This pocket or pouch is formed in foil, paper, laminated strip or film which is shaped by manipulative means rather than stretching or heat forming of the pocket. An "I" shaped transverse cut is formed in the travelling strip with the sides as carrier edges left intact so that the strip is not completely severed. Near these transverse cuts the strip is formed into end stops by folding and shaping. After forming, the product is placed into these receiving pockets or pouches. A cover is brought to this carrier strip and is sealed to this carrier strip to enclose and encapsulate the product. After this step is completed, the carrier strip is preferably further severed at the transverse cuts to provide individual packages.

In the embodiment to be more completely described, there are depicted pouches or pockets as formed in the lower carrier strip. The lower carrier strip has a transverse cut made in the form of an "I". This lower carrier strip is formed into a trough which includes parallel side edges. End stops are then formed and brought in place and a fold is made at the four corners. The end folds provide outstanding ribs which normally extend in the same plane as the retaining sides of the pocket. After filling of the pocket with a product, a cover is sealed in place. The filled and sealed pocket may be further severed from the strip and as individual packages accumulated.

The package material may be a foil, paper, a laminate having an interior plastic coating or any other material that is compatible with the product to be packaged. The cover member may be a film and attached to the carrier member as by heat sealing or may be a film or paper member attached as by an adhesive which is preliminarily applied or may be applied just prior to sealing. In said embodiment, to be hereinafter more fully described, it is to be noted that the lower packaging materials, although shaped by dies, fingers and the like, have a transverse "I" shaped slit formed in one of the members. The formed slit not only prevents but provides that the packaging materials are not stretched or weakened. Heat and other stretching means commonly used weakens the package, particularly at the corners.

In addition to the above summary, the following disclosure is detailed to insure adequacy and aid in understanding of the invention. This disclosure, however, is not intended to cover each new inventive concept no matter how it may later be disguised by variations in form or additions of further improvements. For this reason, there has been chosen an embodiment of a formed pocket of and in a lower carrier strip as adopted for use in packaging foods and the like and showing a preferred means for cutting, forming, folding, filling and sealing the product. This specific embodiment and the apparatus for producing said package has been chosen for the purposes of illustration and description as shown in the accompanying drawings wherein:

SCORING MECHANISM OF FIGS. 1A AND 1B

Figure 1A:
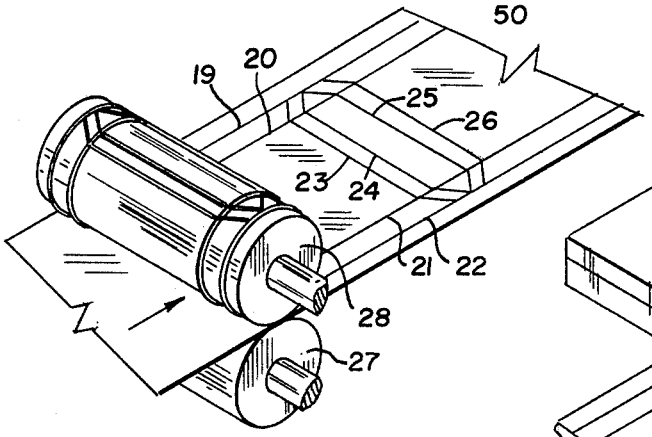
FIGS. 1A and B represent isometric views, partly diagrammatic, and showing mechanism for making shallow score lines in the lower film to assist in making controlled subsequent folds in the lower member.

Referring next to the drawings, there is diagrammatically shown apparatus that may be used to longitudinally provide score lines 19, 20, 21 and 22 in a lower film laminate or foil member 50. Transverse score lines 23, 24, 25 and 26 having diverting end portions may also be provided. These score lines are very shallow and are not intended to stretch or otherwise alter the integrity of the lower member 50. In FIG. 1A the score lines are shown as produced by rollers 27 and 28 which are disposed to pass this lower member 50 therethrough. Power is provided to these rollers if and when needed. The rollers are carried on shafts or axles adjustably mounted to provide the desired depth of score impressions.

Figure 1B:
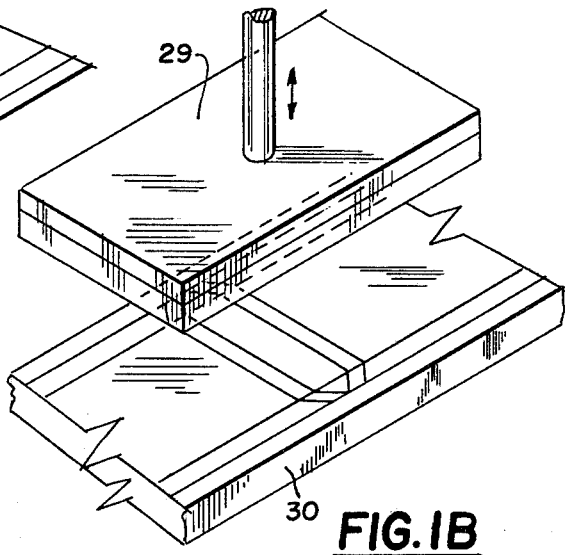

In FIG. 1B the diagrammatic showing is for the score lines to be produced by reciprocating dies 29 and 30. These dies are moved by cylinders or cam means, not shown, and are adjustable so as to provide shallow score lines of a determined depth. It is to be noted that score lines 19 through 26 may not be desired or needed in and with certain packaging and thus are not claimed in the broad concept.

EMBODIMENT OF FIGS. 2A AND 2B

Diagrammatically shown are roller dies 31 and 32 which are rotated as the carrier member is advanced. These roller dies produce and provide an "I" cut 52. Alternate cutting may be produced by reciprocating upper and lower dies 33 and 34 which also are adapted to produce cut 52. Rod 35 and a companion rod not shown are cycled toward and to member 50 when and as said member 50 is stopped in its advancement. Either of these cutting concepts and apparatus may be used and it is merely a matter of preference. The width of the cut and the length of the longitudinal cut portions are a matter of selection determined by the desired shape and capacity of the container. This consideration also determines the spacing between cuts.

Figure 2A:
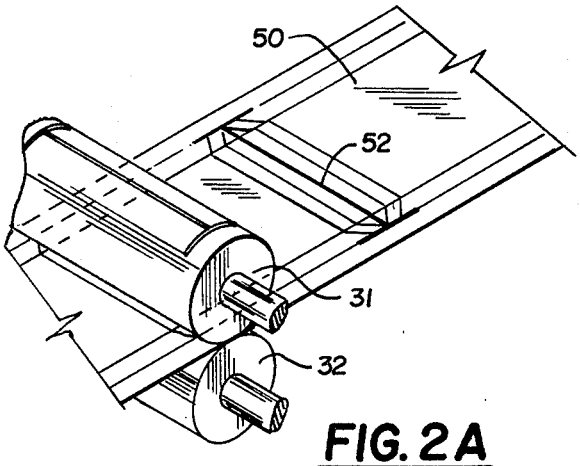
FIGS. 2A and B represent isometric views, partly diagrammatic, and showing mechanism for making an "I" cut in the lower member.
Figure 2B:
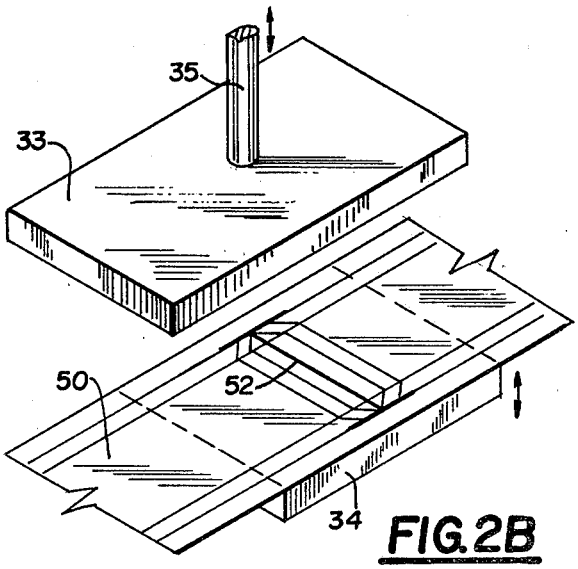

It is to be noted that the score line dies of FIG. 1A may be combined with the cutting dies of FIG. 2A to provide combined cutting and scoring operations. In a like manner the scoring dies and cutting dies provided and depicted in FIGS. 1B and 2B may be combined. Such a combination is only suggested since the mechanism is conventionally performed as shown for the sake of maintenance and observation.

EMBODIMENTS OF FIGS. 3A AND 3B

Figure 3A:
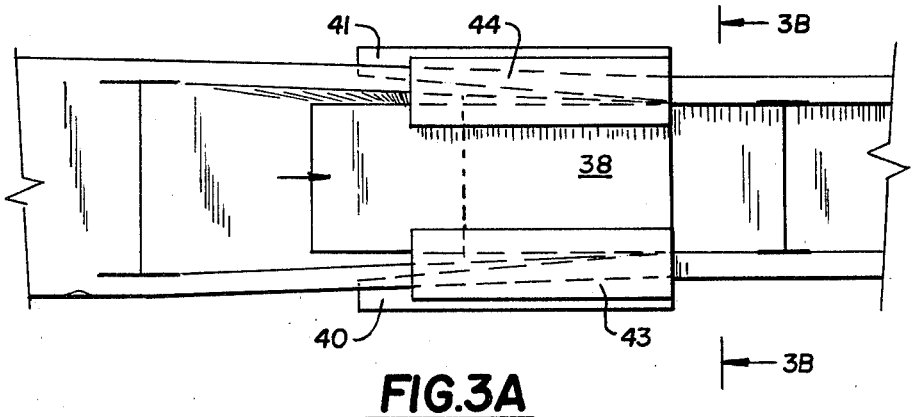
FIGS. 3A and B represent plan and sectional views, partly diagrammatic, and showing forming mechanism to bring the lower member to a trough shape with substantially vertical, longitudinal side walls, this mechanism employing a folding and shaping shoe and side plows.
Figure 3B:
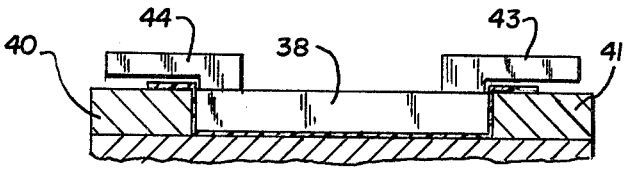
Figure 4A:
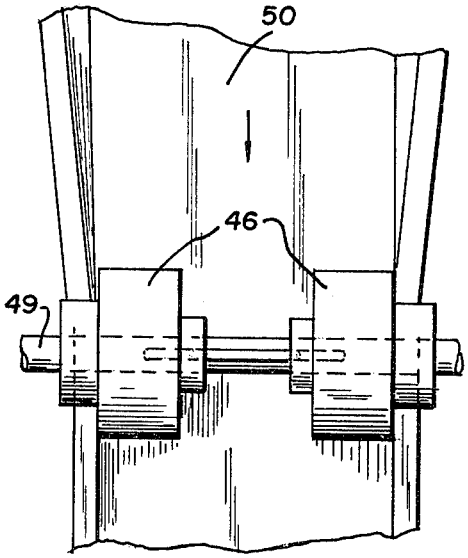
FIGS. 4A and B represent plan and sectional views, partly diagrammatic, and showing roller mechanism for folding and shaping the lower member into a trough with substantially vertical side walls.
Figure 4B:
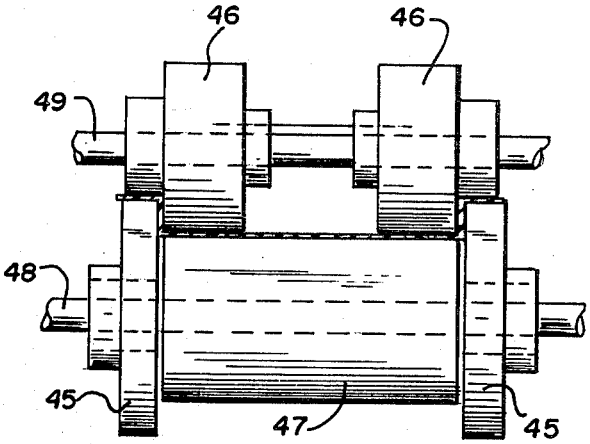

A forming of a trough in the traveling web 50 is provided as in FIGS. 3A and 3B by a stationary shoe 38 which guides or displaces the member 50 from its delivered plane to its finished position and shape below the delivered plane. The outer sides of this member 50 are urged or guided inwardly by outer guide members 40 and 41. These guide members are tapered inwardly to provide the desired inward shaping of the member 50. At the same time that the sides are urged inwardly to form the side portions of the member 50 there are upper shoes 43 and 44 that insure that the outer carrier portions of the member 50 remain in its delivered plane.

EMBODIMENT OF FIGS. 4A AND 4B

The trough may also be formed with and by adjusted mating rollers 46 and 47. These rollers are carried on shafts or axles 48 and 49 which are powered and are turned toward each other. These rollers have contours that are adjusted to mate and match with each other to provide the desired configuration of the member 50. The use of rollers to provide the desired inward draw of the member 50 as in FIGS. 3A and 3B is very difficult therefor the probable use of rollers are only for special contours, particularly shallow box configurations.

EMBODIMENT OF FIGS. 5 THROUGH 11

As shown diagrammatically in FIGS. 5 through 11, the formation of the carton, filling and sealing is pictorially and progressively depicted. A lower carried strip 50 is partially severed by a transverse cut 52 which does not extend to the side edges of the strip. Each transverse cut is terminated with short cuts 53 and 54 at the ends thereof and substantially parallel to the edges 55 of the strip 50. Cuts 53 and 54 are formed a short distance in from the edges 55 and those portions of 56 exterior of these cuts provide the carrying means for said lower strip. In FIGS. 2A, 2B, 3A, 3B, 4A and 4B are diagrammatically shown apparatus for cutting the strip 50 and forming this travelling strip into a shallow trough in which longitudinal sides 57 may be normal to the top carrying strip portions or may be slightly sloped, if desired. Folding and forming of this lower carrier strip is shown by fixed mechanism and/or rollers but may be accomplished in other conventional ways known to those skilled in the art and in issued patents.

Figure 11:
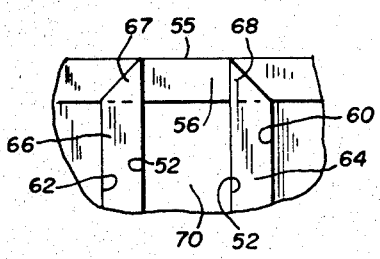
FIG. 11 shows a fragmentary plan view of the corner construction in enlarged scale and providing therewith the folds and the pocket having no stretching or breaks in the formed film.
Figure 10:
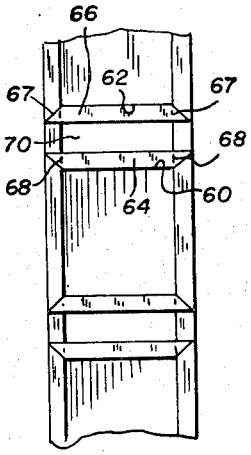
FIG. 10 represents the plan view of this strip of FIG. 9 with the ends of the pocket now forming end walls and with the folded tabs now placed for sealing.

After the trough has been formed and in timed relationship with the advancement of the member 50 the cut is sensed or otherwise placed in an alignment with end forming fingers 80 and 85 which as in later described apparatus, said member 85 is moved upwardly to cooperate with upper folding members to cause substantially vertical end members 60 and 62 to be formed. These upper forming members or fingers are moved into the trough to assist in the upward and end folding of portions 60 and 62. After the ends have been formed and moved upwardly from the trough, horizontal end shelf members 64 and 66 are formed by folding toward each other and in the plane of portions 56. After displacing from the trough, the outer ends of the shelf members 64 and 66 are folded to provide overlaying portions 67 and 68, as seen in FIGS. 10 and 11. A space or gap 70 is thus provided in the carrier 50 after a pocket has been formed in the strip 50. This space or gap 70 is substantially equal to the length of ends 60 plus 62. The shelf members have a developed width substantially equal to the lengths 53 or 54 made with the "I" cut. When the shelf members 62 and 64 are folded into the plane of the side members 56, they form triangular portions 67 and 68 which may either be next to or above side carrier portions 56. The folding placement of the corner is merely a matter of preference.

Figures 5, 6:
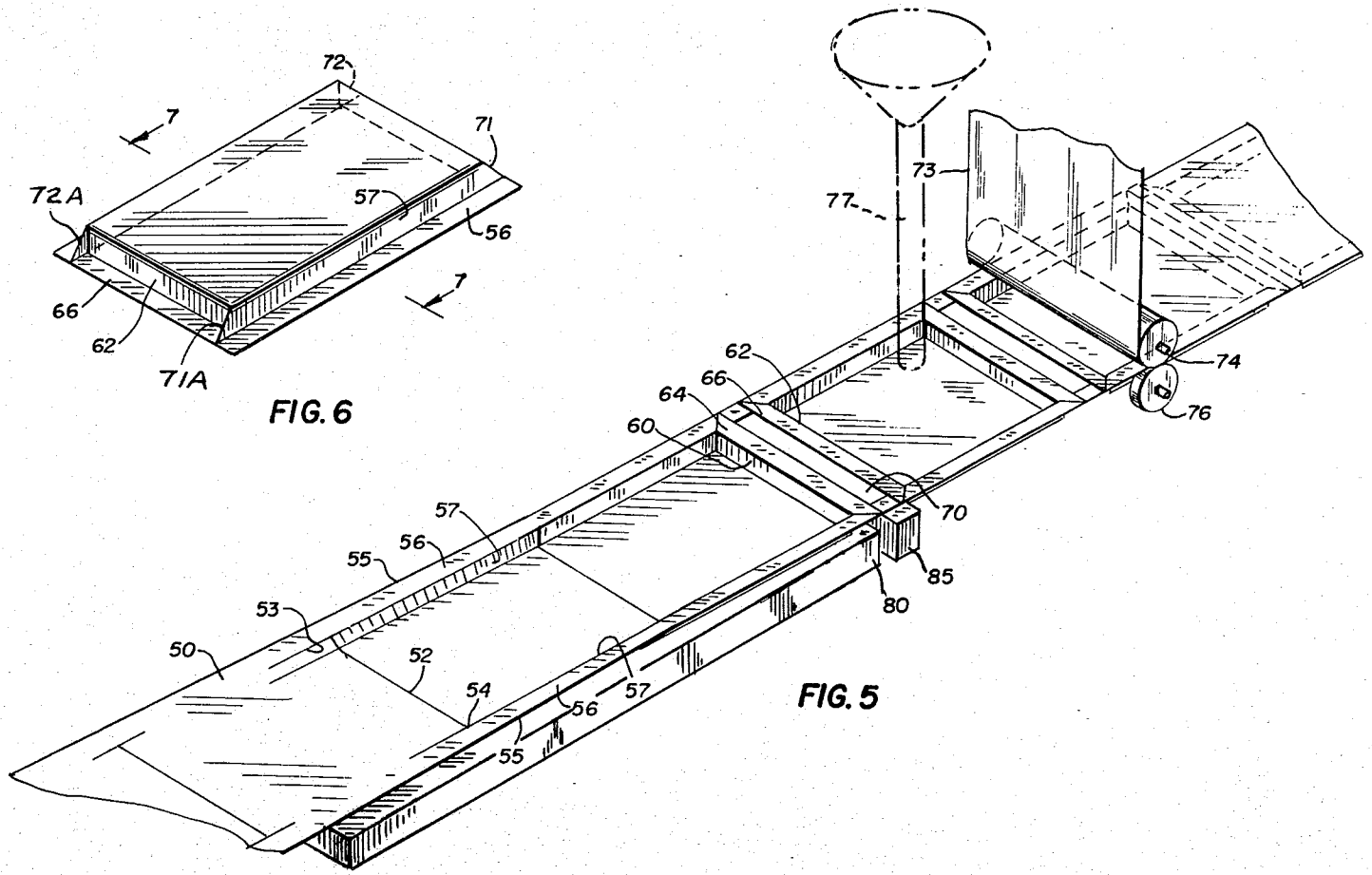
FIG. 5 represents a partly diagrammatic, isometric view of the package forming apparatus in which the carrier strip is partly severed with an "I"-type cut and in which a pocket is formed in the bottom strip with end and side panels and a folding operation is provided at the four corners of the pocket.
FIG. 6 represents the bottom view in an enlarged scale of the packaged product as produced in the sequence of operation in FIG. 5.
Figure 7:
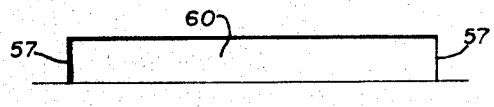
FIG. 7 represents a sectional view of the package of FIG. 6, this view taken on the line 7—7 and looking in the direction of the arrows.

Referring now to the underside of the product pocket and the view of FIG. 6 showing the underside of the package tray, it is to be noted that with the forming of the ends 60 and 62 and shelf portions 64 and 66 with tapered portions 67 and 68, bottom ribs are formed. These portions are depicted as being in alignment with the sides 57 and are designated 71, 71A, 72 and 72A. A different folding pattern may be provided other than that shown, in which case the folded ends 71, 71A, 72 and 72A will be at a different angle rather than in alignment with the side portions 57.

Figure 14A:
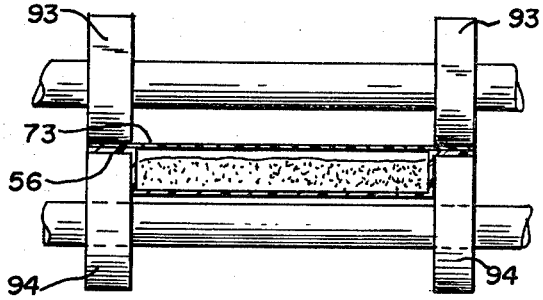
FIGS. 14A and B represent sectional views, partly diagrammatic, and showing the sealing of the cover to the bottom container.
Figure 14:
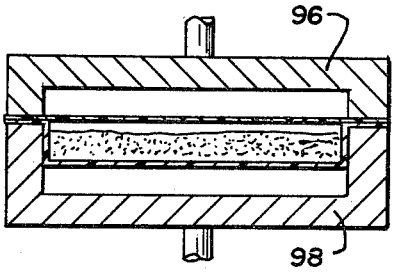
Figure 15:
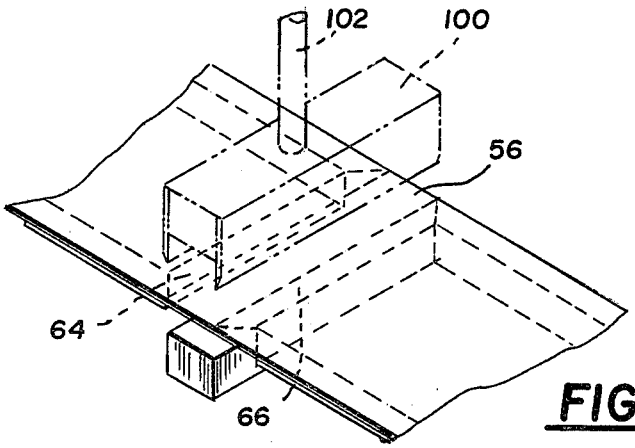
FIG. 15 represents an isometric view, partly diagrammatic, and showing mechanism for cutting the now packaged carton into separate components.

Referring once again to FIGS. 5, 10 and 11, it is to be noted that after the bottom tray has been formed it may be filled by a spout 77 which carries and delivers a product which may be granular, solid, semisolid, semiliquid or liquid after which a cover 73 is brought into place. Cover 73 is guided and urged by rollers 74 and 76 to bring this cover to the carrier tray where this cover is affixed in place either by heat sealing or by a localized glue application. A transverse seal or seals is made by sealing mechanism as seen in FIGS. 14A and 14B. After the sealed package is formed, cutting means conventionally known and shown in FIG. 15 is provided to separate the packages into separate components.

The package concepts anticipates utilization of a standard flat package material which is manipulated in an intermittent or continuous manner so as to provide for more volume in a formed pouch. Normally the material used is impervious to water and air so that a seal provides a hermetic protection to the contents. The interior of this package is normally provided with a sealing surface such as film and preferably sealing bars operate on the flat web line to provide the desired package.

MULTI-WIDTHS AS IN FIG. 12

Figure 12:
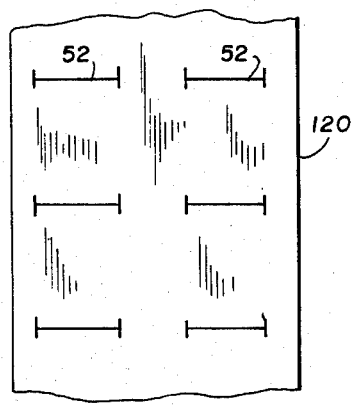
FIG. 12 represents a fragmentary plan view showing the bottom strip cut for plural pockets.
Figure 8:
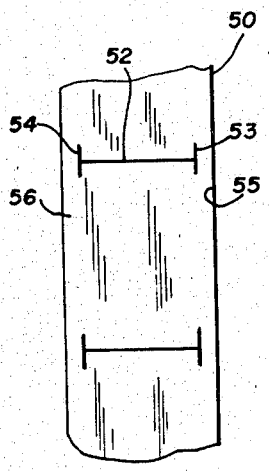
FIG. 8 represents a fragmentary plan view of the carrier strip of FIG. 5 and showing in particular the "I" shaped transverse cuts in this travelling strip.

In FIG. 12 there is depicted a sheet or strip 122 in which side-by-side cuts are made in said strip. This showing is for the making of a plurality of packages in one strip. The strip is manipulated to accommodate the forming of the trough and the necessary inward movement to accommodate this troughing. Not shown is a possible lengthwise slitting of the sheet to allow each strip of packages to be separately formed, filled and later sealed then severed.

CORNER FOLDING AS IN FIG. 13A

Figure 9:
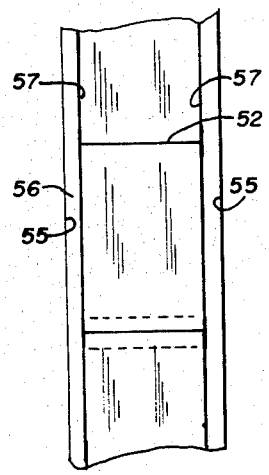
FIG. 9 represents the fragmentary plan view of the travelling strip of FIG. 8 now folded to provide the side walls of the pocket.

In FIGS. 9 and 10 the laminate or foil member 50 is shown as being formed into a trough with cuts 52, 53 and 54 defining the side extent of the trough. The length of the short cuts 53 and 54 extending beyond the transverse cut 52 define the depth of the trough. The sidewalls 57 are the length of the cuts 53 and 54 and extend from cut 52. Conventionally, these sidewalls are substantially vertical and the carrier strips 56 remain in the same plane as originally carried.

Figure 13A:
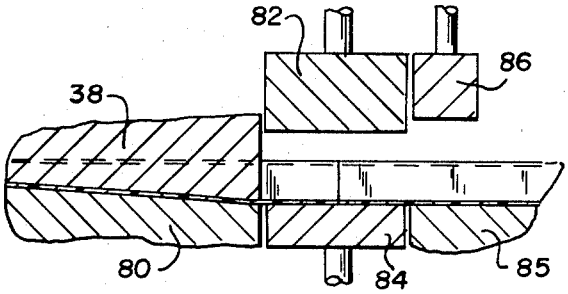
FIGS. 13A through G represent the forming and folding of the corners of the container bottom as shown in FIGS. 5 through 11, these views partly diagrammatic but showing the folding being achieved by a mechanism illustrating one means of achieving a folding of the corner.

In FIG. 13A a table 80 is disposed below a stationary shoe 38 which engages and directs the laminate or foil member 50 downwardly to form the trough condition. The transverse "I" cut 52 is carried below shoe 38 and the cuts 53 and 54 are disposed below a movable actuator 82. A lower actuator 84 is also movable and is of the same size as the upper actuator 82. A flat stationary member 85 is adjacent to and is a guide for actuator 84. This stationary member has its upper surface disposed to provide a support for the lower trough portion of the member 50. Folding may utilize the score lines or may be achieved without said lines.

CORNER FOLDING CONTINUED AS IN FIGS. 13B AND 13C

Figure 13C:
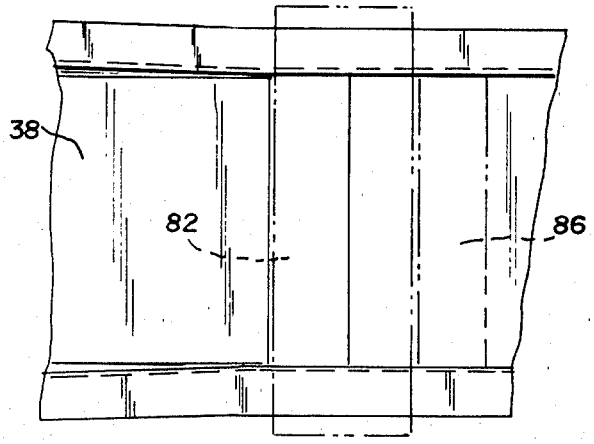
Figure 13B:
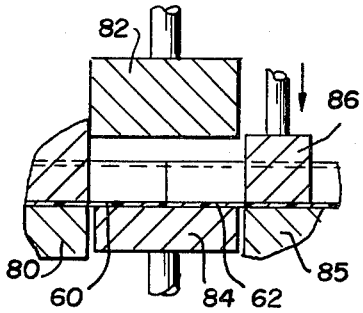

The components as defined in FIG. 13A are in this continuation as seen in FIGS. 13B and 13C of the folding operation. Table 80 and stationary member 85 remain as before. A folder bar 86 which has been moved toward and into the troughed portion of the laminate or foil member 50 supports said member. The actuator bar 82 has moved downwardly to bring folder bar 86 into retaining condition of the member 50 at the bottom of the trough as shown.

CORNER FOLDING CONTINUED AS IN FIG. 13D

Figure 13D:
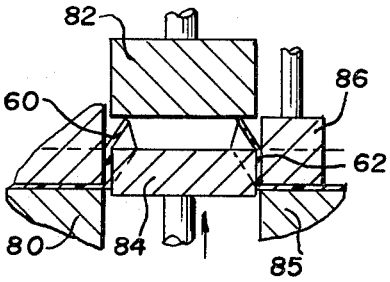

The several components stated as in FIGS. 13B and 13C are shown in FIG. 13D. This figure shows the starting of the end folding to provide end walls 60 and 62.

Actuator 82 is as in the immediately preceding figure with folder bar 86 in the down position. The lower actuator 84 has now moved upwardly to cause the end walls 60 and 62 to be folded upwardly and the actuator 82 is positioned to cause the portions 64 and 66 to be partially folded or turned to the condition of FIG. 10.

CORNER FOLDING CONTINUED AS IN FIG. 3E

Figure 13E:
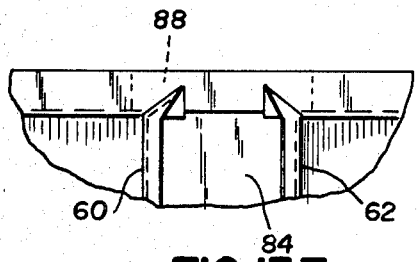

In FIG. 13E, the troughed member 50 is shown being partially folded. The ends outside the trough are turned by like side movable members 88 and 90. The opposite side member 90 is not seen in this view. This bottom view shows actuator 84 insuring the folding of the corners to the condition desired.

CORNER FOLDING CONTINUED AS IN FIGS. 13F AND 13G

Figure 13F:
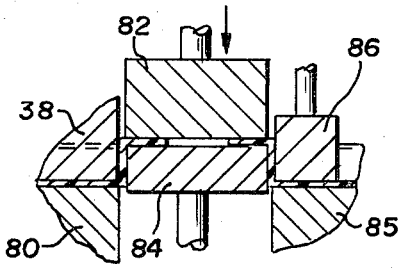
Figure 13G:
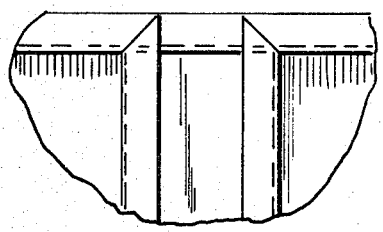

As seen in FIGS. 13F and 13G, the upper actuator 82 and lower actuator 84 are brought together and with movable members 88 and 90 bring the corners of the tray sufficiently together to produce a flat condition as in FIG. 11.

As and after the lower shallow box has been formed, material as delivered by the spout 77 is delivered in a desired quantity into the erected container. The end formation, as depicted in FIG. 13H, and the folded corners are amenable to the sealing of the lower container by means of an upper film 73 as seen in FIG. 5. Preferably, longitudinal rollers 91 and 92 may be used in conjunction with the upper film or instead of the rollers 74 and 75 as shown in FIG. 5. The attachment of the uppercover film to the container is now achieved. The embodiment of FIG. 5 contemplates the filling of the laminated or film foil into the configuration as seen in FIG. 6 which shows a bottom view of the container. It is to be noted that the filling of the film or laminate produces corners 71, 71A, 72 and 72A. A different folding technique may provide for corners 71, 71A, 72 and 72A with a different configuration.

SIDE SEALING AS IN FIG. 14A

In FIG. 5, rollers 74 and 75 are figuratively shown. These rollers are, of course, carried by journaled shafts. These rollers may be contoured as in FIG. 14A or additional rollers may be supplied. As shown, rollers 93 and 94 are adapted to pass the filled container therealong. The outer edges are adapted to press the cover 73 into a sealing condition with the side carrier strip 56. Heated rollers are utilized where heat sealing is to be made. With adhesive sealing, adhesive application and pressure is supplied as required and desired.

END SEALING AS IN FIG. 14B

The package is sealed transversely by die means 96 and 98 which may or may not be heated. The seal of the cover to the package is contemplated to extend to the side edges 55 of the package. This sealing of the cover at and over the folded corners insures the integrity of the package. The sealing by heat and the use of a thin member in both the cover and lower container insures that the folded corner is not excessive. Where and when adhesive is used the added adhesive secures the cover to the folded corner in an airtight manner.

CUTTING WITH KNIFE AS IN FIG. 15

The carrier strips 56 between end surfaces 64 and 66 are severed to make individual packages. The knife 100, carried by piston shaft 102, may be actuated by a pneumatic cylinder or other mechanism. The cutting may remove all or nearly all the carrier 56 between end surfaces 64 and 66 and/or may additionally provide a shaped trim. The ultimate use determines the knife shape and actuation which is considered to be conventional and a matter of selection.

In the forming of a trough or pouch in the lower web, it is noted that this troughing or forming does not stretch or weaken the carrier. The troughing and/or forming causes a diminishing of the width of the package. The edges and those transverse portions next to the cut are maintained substantially so that a seal can be easily and readily made by heat and/or pressure so that the filled packages may be carried through the apparatus by standard drive or advancing mechanism.

As a method, the above apparatus provides the steps of: providing and advancing a lower member of determined width and of a long length sheet material adapted to form a series of receiving pockets; forming a series of substantially identical transverse cuts in said lower member and at substantially equal and regular intervals, these cuts less than the width of the lower member therewith and thereby leaving side carrier portions in the lower member; troughing said lower member, said trough extending substantially the same width in the lower member as the transverse cut; forming an end stop on each side of each transverse cut and with these stops and the trough providing a product receiving pocket, said end stops being formed in the lower member absent heat and stretching of said member so that the integrity of all wall portions of the pocket remain substantially unchanged in their travel through the forming steps, delivering a desired quantity of product to and into the formed pocket of the lower carrier; attaching a cover to the rim portions around the pocket to retain the product in said pocket; and subsequently severing the sealed pockets into separate packages. The above method also provides additional steps as in the claims.

The above embodiment is shown for the purpose of providing an example of apparatus which may be used to form, fill and seal and sever a tray produced with substantially vertical side and end walls. The scoring, cutting and folding are examples of how the forming and folding of the lower tray may be achieved although other means may be utilized. The cutting of the laminate or foil member 50 with a series of like "I" cuts may include a plurality of like side-by-side cuts to provide trays simultaneously erected and to then fill and seal as above. The eventual package determines the apparatus and actuation.

Terms such as "left", "right", "up", "down", "bottom", "top", "front", "back", "in", "out" and the like are applicable to the embodiments shown and described in conjunction with the drawings. These terms are merely for the purposes of description and do not necessarily apply to the position in which the pouch or pocket in the carrier web may be constructed or used.

While a particular embodiment of the package formed in the carrier strip has been shown and described, it is to be understood that the carrier strip members may be disposed at any angle from horizontal to vertical, and the invention is not limited by this disclosure since modifications may be made within the scope of the accompanying claims and protection is sought to the broadest extent the prior art allows.

What is claimed is:

1. Apparatus for the in-line production of a package for a product which may be granular, solid, semisolid, liquid and/or combinations thereof, said produced package including a lower member and a cover member, said members having facing surfaces adapted for sealing one to the other, said apparatus including:

(a) means for feeding and supporting a lower member of determined width and of a long length of sheet material;

(b) means for forming a plurality of substantially transverse "I" cuts in said lower member and at substantially equal and regular intervals, these cuts being less than the width of the lower member thereby leaving side carrier portions on the lower member, each of said "I" shaped cuts having the bar portion of said "I" cut substantially transverse to the length of the lower member and at each end of the bar portion of the cut there are short cuts substantially parallel to the long edges of the lower member;

(c) means for forming a trough in said lower member, said trough having substantially the same width in the lower member as the length of said transverse cuts;

(d) die shaping means for forming an end stop on each side of each transverse cut and with these end stops and the trough providing a product receiving pocket, said end stops being formed in the lower member absent heat and stretching of said member so that the integrity of all wall portions of the pocket remain substantially unchanged in their travel through the apparatus;

(e) means to feed a desired quantity of product to and into the formed pocket of the lower carrier;

(f) means for attaching a cover member to the rim portions around the pocket to retain the product in the pocket, and (g) means for severing the sealed pockets into separate packages.

2. Apparatus for the in-line production of a package for a product as in claim 1 in which the trough is formed with generally planar side portions generally parallel to the side edges of the lower member and the end stops extend from one short cut portion to an opposite short cut portion, each end stop including the side portions of the trough between cuts, each end stop including a portion which extends upwardly from the bottom of the trough to a level substantially at the level of the carrier edges and with the end stop further folded toward the transverse cut to provide an end sealing means for retaining the cover as it is sealed in place.

3. Apparatus for the in-line production of a package for a product as in claim 2 in which the end portions of the end portions of the end stops which are brought to the plane of the carrier strips have their ends further folded to provide a flat surface.

4. Apparatus for the in-line production of a package for a product as in claim 3 in which the forming of the folded ends provide multi-layers which are pressed flat so that the resulting package with said applied cover provides a seal of the contents.

5. Apparatus for the in-line production of a package for a product as in claim 4 in which the outer corners are disposed in a plane substantially parallel to the side edges of the lower member.

6. Apparatus for the in-line production of a package for a product as in claim 2 in which the planar portion of said folded corners are pressed flat and with the cover are sealed into a fixed retained condition.

7. A method for forming a package for a product which may be granular, solid, semisolid, liquid and/or a combination thereof, said package including a lower member and a cover member, said members having facing surfaces adapted for sealing one to the other, the steps of forming said package including:

(a) providing and advancing a lower member of determined width and of a long length of sheet material adapted to form a series of receiving pockets;

(b) forming a series of substantially identical transverse "I" cuts in said lower member and at substantially equal and regular intervals, these cuts less than the width of the lower member thereby leaving side carrier portions in the lower member, said "I" shape having the bar portion of said cut disposed substantially transverse to the length of the lower member with each end of this cut having short cuts formed substantially parallel to the long edges of the lower member;

(c) troughing said lower member, said trough extending substantially the same width in the lower member as the transverse cut;

(d) forming an end stop at and on each side of each transverse cut and with these stops and trough providing a product receiving pocket, said end stops being formed in the lower member absent heat and stretching of said member so that the integrity of all wall portions of the pocket remain substantially unchanged in their travel through the forming steps;

(e) delivering a desired quantity of product to and into the formed pocket of the lower carrier;

(f) attaching a cover to the rim portions around the pocket to retain the product in the pocket, and (g) severing the sealed pockets into separate packages.

8. A method for providing a package for a product as in claim 7 which further includes forming the trough with generally planar side portions generally parallel to the side edges of the lower member and with the end stops extending from one short cut portion to an opposite short cut portion, each end stop including that side portion of the trough between cuts and forming each end stop with a portion which extends upwardly from the bottom of the trough to a level substantially at the level of the carrier edges and then forming this end stop with a further folded portion toward the transverse cut to provide an end sealing means for retaining the cover as it is sealed in place.

9. A method for providing a package for a product as in claim 7 which further includes forming the end portions of the end stops which are brought to the plane of the carrier strips so as to have their ends further folded, therewith providing a flat planar surface for the attachment of the cover.

10. A method for providing a package for a product as in claim 9 which further includes the folding of the corners so that the outer portions are substantially parallel to the side edges of the lower member.

* * * * *